US007088331B2

(12) United States Patent
O'Donnell et al.

(10) Patent No.: US 7,088,331 B2
(45) Date of Patent: Aug. 8, 2006

(54) METHOD AND APPARATUS FOR CONTROLLING COMMON MODE ELECTRODE VOLTAGE IN LCOS/LCD

(75) Inventors: Eugene Murphy O'Donnell, Fishers, IN (US); Brent William Hoffman, Mooresville, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 216 days.

(21) Appl. No.: 10/182,694

(22) PCT Filed: Nov. 29, 2001

(86) PCT No.: PCT/US01/44803

§ 371 (c)(1),
(2), (4) Date: Jul. 30, 2002

(87) PCT Pub. No.: WO02/44795

PCT Pub. Date: Jun. 6, 2002

(65) Prior Publication Data

US 2003/0098835 A1 May 29, 2003

Related U.S. Application Data

(60) Provisional application No. 60/250,273, filed on Nov. 30, 2000.

(51) Int. Cl.
*G09G 3/36* (2006.01)

(52) U.S. Cl. ..... 345/100; 345/204

(58) Field of Classification Search ..... 345/87, 345/90, 98, 100, 88, 89, 91, 92, 93, 94, 95, 345/99, 204, 205, 96, 97

See application file for complete search history.

(56) References Cited

U.S. PATENT DOCUMENTS

| | | | | |
|---|---|---|---|---|
| 4,833,525 | A | 5/1989 | Suzuki et al. | 358/29 |
| 5,029,590 | A * | 7/1991 | Allain et al. | 600/523 |
| 5,045,928 | A | 9/1991 | Takaiwa et al. | 358/29 |
| 5,239,368 | A * | 8/1993 | Suzuki et al. | 348/226.1 |
| 5,537,129 | A | 7/1996 | Okada et al. | 345/90 |
| 5,561,442 | A | 10/1996 | Okada et al. | 345/94 |
| 5,920,298 | A | 7/1999 | McKnight | 345/87 |

* cited by examiner

*Primary Examiner*—Richard Hjerpe
*Assistant Examiner*—Jean Lesperance
(74) *Attorney, Agent, or Firm*—Joseph J. Laks; Harvey D. Fried; Christine Johnson

(57) ABSTRACT

A device for controlling common mode electrode voltage in a liquid crystal display includes at least a first sensor for measuring flicker resulting from applying a video signal with a predetermined color and drive level to an imager. A detector for determining a difference between a positive field detector voltage and a negative field detector voltage is used to provide a feed-back loop for feeding back the difference to a controller to adjust the common mode electrode voltage.

20 Claims, 2 Drawing Sheets

METHOD AND APPARATUS FOR CONTROLLING COMMON MODE ELECTRODE VOLTAGE IN LCOS/LCD

This application is a 371 of International Application PCT/US01/44803, filed Nov. 29, 2001, which claims the benefit of U.S. Provisional Application 60/250,273, filed Nov. 30, 2000.

BACKGROUND OF THE INVENTION

1. Technical Field

The invention arrangements relate to the field of LCOS (liquid crystal on silicon) and/or LCD (liquid crystal display) video projection systems. More particularly, the inventive arrangements taught herein are related to automatically adjusting the common-mode electrode voltage in LCOS/LCD projection systems.

2. Description of Related Art

In LCOS systems, it is necessary to set the common mode electrode voltage to be precisely between the positive and negative drive voltages to the pixel. It is typical to drive the imager of an LCOS display with a frame-doubled signal to avoid 30 Hz flicker, by sending first a normal frame in which the voltage at the electrodes associated with each cell is positive with respect to the voltage at the common electrode (positive picture) and then an inverted frame in which the voltage at the electrodes associated with each cell is negative with respect to the voltage at the common electrode (negative picture) in response to a given input picture. The common mode electrode voltage is denoted VITO, wherein the letters ITO denote indium tin oxide, namely the voltage at the electrode substrate of the LCOS wafer made from these materials. Setting VITO in this manner avoids both flicker and image retention, both of which can adversely affect the device lifetime. As this setting is now accomplished by an open-loop control, there is opportunity for error in VITO, and drift with time and temperature.

The typical implementation of the prior art is to use an open-loop DAC (digital to analog converter) to allow the adjustment of VITO using a fast photodiode pick-up and a visual alignment using an oscilloscope and an operator.

The present state of the art in LCOS requires the adjustment of the common-mode electrode voltage to match the positive and negative field drive for the LCOS. The balance is necessary in order to minimize flicker, as well as to prevent the phenomenon known as "image sticking". In order to avoid visible flicker, it is common practice to use a higher frame rate, typically 120 Hz, to suppress flicker. However, the higher frame rate makes adjustment of the common mode electrode voltage more difficult, as the flicker is not visible to the human eye. An operator can not make the necessary adjustments. This can be overcome using a photodiode, or other fast detector, and balancing the AC component of the output. Unfortunately, this open-loop adjustment can be insufficient due to thermal effects in the system.

Thus, a need exists for controlling common mode electrode voltage in a LCOS/LCD in a manner that automatically accounts for the thermal effects in the system and overcomes the inability to make manual adjustments due to the higher frame rates.

SUMMARY OF THE INVENTION

In accordance with the inventive arrangements, at least one sensor is used in the system in order to make the common mode electrode adjustment in a continuous manner using feedback. This can be achieved in several ways in accordance with the inventive arrangements. The first system-level implementation places one or more sensors in the overscan area of the picture. A video signal with the appropriate color and drive level is preferably applied to the imager in order to measure the flicker. A chassis microprocessor can then be programmed to read positive and negative field detector voltages and determine the difference between them. This difference can be advantageously used as feedback to adjust the common mode electrode voltage. Such feedback prevents the possibility of damage to the imager on initial power-up due to an incorrect common mode voltage. Such feedback also ensures that the common mode electrode will be re-adjusted dynamically to minimize image sticking.

In another embodiment of the present invention, a device for controlling common mode electrode voltage in a liquid crystal display comprises a source of polarized light having a predetermined intensity level for illuminating at least a first sensor through a liquid crystal cell and a detector for providing a feedback signal to adjust the common mode electrode voltage for the liquid crystal cell.

DETAILED DESCRIPTION

Figure 1:
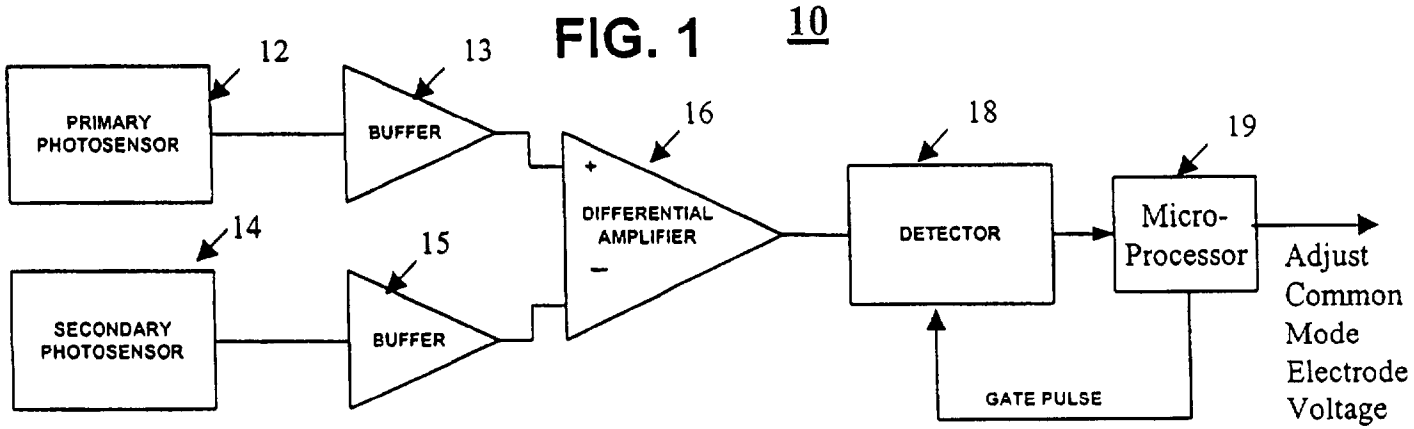
FIG. 1 is a diagram illustrating a discrete implementation for automatically controlling common mode electrode voltage in accordance with the inventive arrangements.

A block diagram of a presently preferred embodiment is shown in FIG. 1. This embodiment 10 uses two sensors, denoted as a primary sensor 12 and a secondary sensor 14, in order to avoid the problems of rejection of ambient light. The differential sensing between the two sensors will subtract out the common-mode signal due to ambient room light. The two sensors can be placed a short distance apart (e.g., 1–2 inches) in the overscan area of the picture. Alternately, the sensors can be placed at other locations in the light path, including under the fold mirrors that typically are found in a television cabinet in the case of systems without overscan. Pinholes, either intentional or naturally occurring, would allow sufficient light to reach the detectors. The differential sensing between the sensors 12 and 14 is preferably achieved by taking the respective outputs of the sensors and buffering them though respective buffers 13 and 15 and using the buffered outputs as inputs to a differential amplifier 16. The output of the differential amplifier 16 serves as an input to a detector 18 which is fed back to the system microprocessor 19 in order to adjust the common mode electrode voltage. The detector 18 is preferably gated and otherwise controlled by the microprocessor. The gate pulse is indicative when the microprocessor 19 samples the signal from the detector 18, and which color of light is being used to illuminate the detector 18. This allows the system to use only one sensor for Red, Green, and Blue imagers and to sense light sequentially from the inverted and non-inverted fields.

The 'signal' sensor 12 can be alternately illuminated with a predetermined light intensity level, based on the video input to the imager. The difference between the light level between the inverted and non-inverted fields is then sent to the detector 18 to determine if the common mode voltage is too high or too low. The sensor 12 will see a variation in light output between the inverted and non-inverted frames. This variation in light output is caused by the slight variation in the RMS voltage on the LC cell between the inverted and non-inverted frames due to the DC imbalance. The amplitude of this variation is controlled by the common mode electrode. The control microprocessor 19 can then decide if a change in the common mode electrode voltage is needed. This can be implemented in either a parallel mode with multiple sensors for each imager color, or in a sequential mode by changing the imager which is producing the illumination. As the response time of the system would be intentionally slow to avoid response to noise, the sequential system would be preferred on the basis of lower cost.

Many types of detectors and methods can be used to implement the inventive arrangements, but the simplest, and perhaps most effective would be a gated comparator, whose output indicates the direction in which to change the common mode electrode voltage. The control microprocessor polls the output bit of the comparator (within a detector), looking for a transition from low to high. Once the low to high transition is detected, the microprocessor confirms that a step in the opposite direction produces a high to low transition, and thus the target voltage has been achieved. As expected, some level of software based hysteresis and averaging will be required. More complex detectors, such as A/D converters or other digital processing can be used, but at present are less likely to be cost effective.

As an additional feature, in order to converge quickly, a reduction of gain for the detector 18, and an increase in the step search size in software can be desirable.

An alternative embodiment that can be equally effective is one that can be integrated into the imager, thus avoiding the problems caused by ambient room lighting. Sensors, for example photodiodes, can be placed on the top of the cover glass over the electronically un-modulated area of the LCOS, and/or the 'ring electrode'. The 'ring electrode' is a common term in LCOS devices. In general, the non-active area of an LCOS display outside the pixel mirrors is a single, large plate. This large plate is reflective, like the rest of the pixels, but has a much larger area, and thus higher capacitance value, than the other pixels.

The ring electrode is also typically driven black in order to suppress stray light from the illumination system from being bounced into the optics. The stray light or the light shining on the ring electrode area is inherently needed to provide assembly tolerance in the optical system so that light will adequately shine on all of the viewable area of a display when required. The 'ring electrode' does not need to be modulated at a high speed like the pixels in the viewable area of an LCOS display, so it can be driven by a low band-width amplifier and for purposes of this embodiment be modulated for a brief period of time and for a level slightly above black without causing any perceptible amount of light from being bounced into the optics. Thus, these sensors can be used to check the zero voltage (unmodulated) and maximum voltage (ring electrode) points on the electro-optical transfer function. The detector voltage from the two photodiodes can then be used to choose the correct common mode electrode voltage. The disadvantage of this alternative is that precision placement of the sensors is required.

Figure 2:
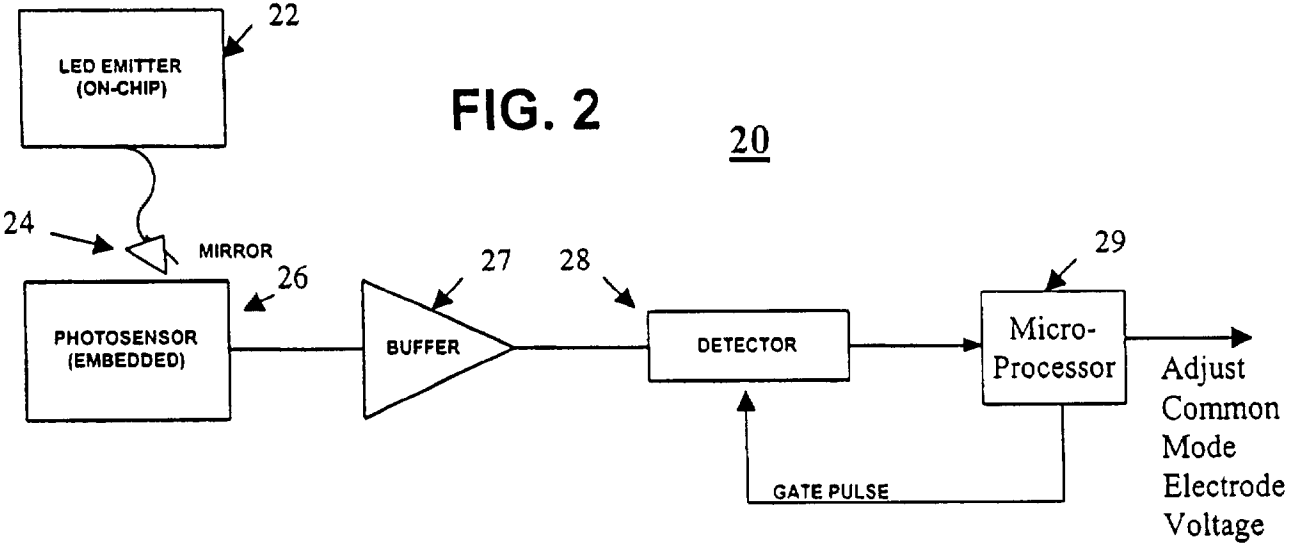
FIG. 2 is a diagram illustrating an integrated implementation for automatically controlling common mode electrode voltage in accordance with the inventive arrangements.

A more highly integrated embodiment of the invention is shown in FIG. 2. In this example, the device 20 comprises a sensing cell or photo-detector 26 that is placed on the periphery of the LCOS device, along with an LED (light emitting diode) 22 to act as the illumination source. A small mirror 24 is placed on the cover glass to reflect the LED light back to the photo-detector 26, which is also formed on the LCOS back plane. The sense amplifier and feed back circuits (not shown) are also integrated on the back plane. As in the prior embodiment, the sensor output is preferably buffered through at least one buffer (27) and the buffered output is used as an input to a detector 28 which is fed back to the system microprocessor 29. Another output from the detector 28 also serves as a gate pulse for the microprocessor 29 as similarly explained with respect the gate pulse to microprocessor 19. The benefits of this approach are a lower cost due to integration on the large silicon area of the imager, and improved immunity to ambient light disturbances. The LED emitter and sensor can also be tuned in invisible wavelengths (e.g., infrared) if desired to avoid loss of contrast. In this embodiment, the voltage out of the detector 28 is measured to make a corresponding change in the common mode electrode voltage. The voltage out of the photo diode detector (28) is proportional to the optical power falling on the sensor 26. In the long run, such integration should provide the lowest cost alternative.

Figure 3:
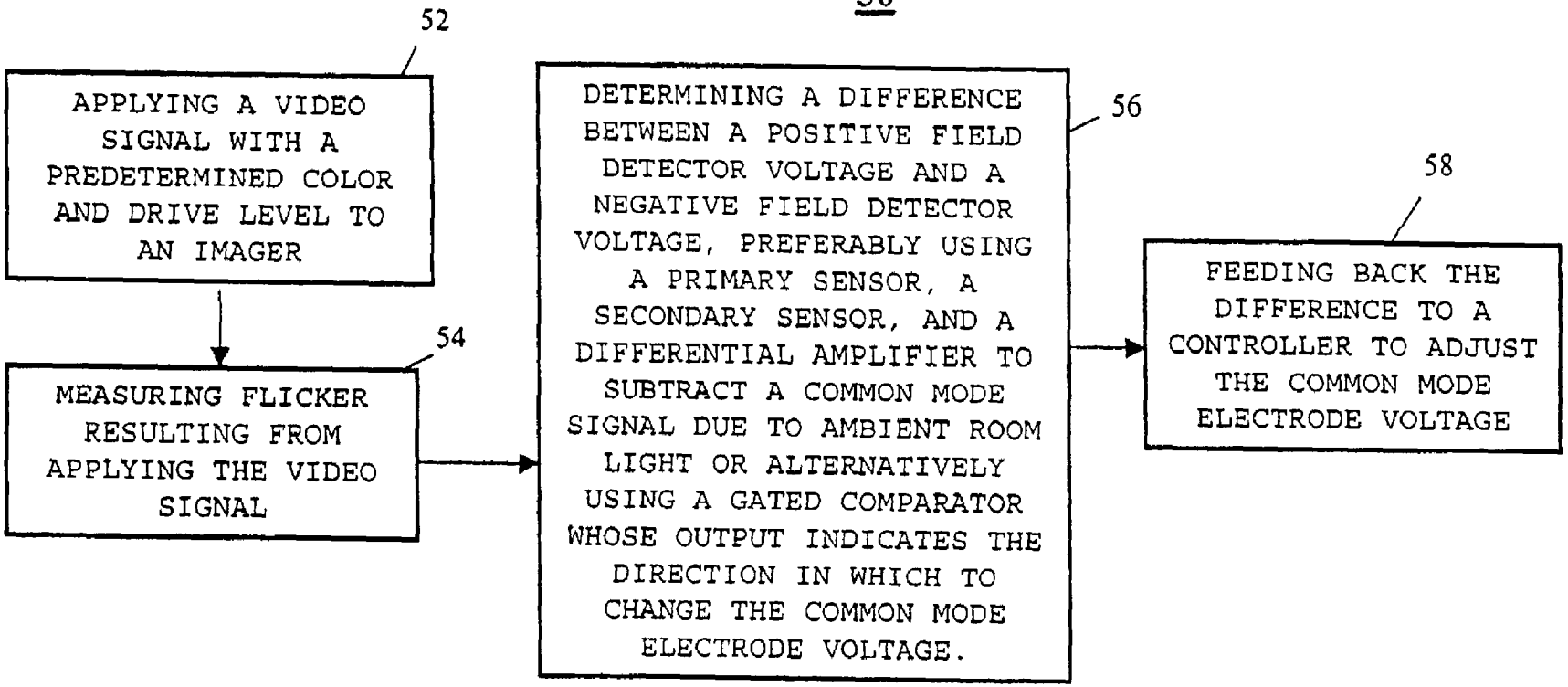
FIG. 3 is a flow chart illustrating a method in accordance with the present invention.

Referring to FIG. 3, a method 50 of controlling common mode electrode voltage in a liquid crystal display is illustrated. Preferably, the method 50 comprises the steps of applying a video signal with a predetermined color and drive level to an imager at block 52 and measuring flicker resulting from applying the video signal at block 54. The method 50 at block 56 then determines a difference between a positive field detector voltage and a negative field detector voltage and at block 58 the difference is feed back to a controller to adjust the common mode electrode voltage. The step of determining can be achieved in many ways. For example, using at least one sensor in an overscan area of a picture or using a primary sensor, a secondary sensor, and a differential amplifier to subtract a common mode signal due to ambient room light, or using a gated comparator whose output indicates the direction in which to change the common electrode voltage. The method may also comprise the step of re-adjusting the common mode electrode voltage dynamically to minimize image sticking.

Although the present invention has been described in conjunction with the embodiments disclosed herein, it should be understood that the foregoing description is intended to illustrate and not limit the scope of the invention as defined by the claims.

The invention claimed is:

1. A method of controlling common mode electrode voltage in a liquid crystal display, comprising the steps of:

applying a video signal with a predetermined color and drive level to an imager;

determining a difference between a positive field detector voltage and a negative field detector voltage; and feeding back the difference to a controller to adjust the common mode electrode voltage.

2. The method of claim 1, wherein the step of determining further comprises the step of using at least one sensor in an overscan area of a picture.

3. The method of claim 1, wherein the method further comprises the step of readjusting the common mode electrode voltage dynamically to minimize image sticking.

4. The method of claim 2, wherein the step of determining further comprises the step of using a primary sensor, a secondary sensor, and a differential amplifier to subtract a common mode signal due to ambient room light.

5. The method of claim 1, wherein step of determining a difference further comprises the step of using a gated comparator whose output indicates the direction in which to change the common electrode voltage.

6. The method of claim 1, wherein the step of determining a difference further comprises the step of using sensors.

7. The method of claim 1, wherein the step of determining a difference comprises the step of measuring flicker resulting from applying the video signal.

8. A device for controlling common mode electrode voltage in a liquid crystal display, comprises:

a detector for determining a difference between a positive field detector voltage and a negative field detector voltage; and a feed-back loop for feeding back the difference to a controller to adjust the common mode electrode voltage.

9. The device of claim 8, wherein the device comprises a primary photosensor and a secondary photosensor placed a short distance apart in an overscan area of a picture.

10. The device of claim 8, wherein the device comprises a primary photosensor and a secondary photosensor placed under a plurality of fold mirrors in a system without overscan.

11. The device of claim 8, wherein the device further comprises a pinhole in the display to allow sufficient light to reach said at least first sensor.

12. The device of claim 8, wherein the detector comprises a gated comparator whose output indicates the direction in which to change the common electrode voltage.

13. The device of claim 8, wherein the device further comprises a source of light having a predetermined intensity level for illuminating said at least first sensor based on a video input to an imager for the liquid crystal display.

14. The device of claim 8, wherein the detector for determining a difference comprises at least a first sensor for measuring flicker resulting from applying a video signal with a predetermined color and drive level to an imager.

15. A device for controlling common mode electrode voltage in a liquid crystal display, comprises:

a source of polarized light having a predetermined intensity level for illuminating at least a first sensor through a liquid crystal cell; and a detector responsive to an output of said first sensor for providing a feedback signal to adjust the common mode electrode voltage for the liquid crystal cell.

16. The device of claim 15, wherein the device further comprises a mirror placed on a cover glass to reflect and direct said radiation towards said at least first sensor.

17. The device of claim 16, wherein said at least first sensor and detector is integrated into a back plane of the liquid crystal display.

18. The device of claim 16, wherein said at least first sensor is a photo-sensor integrated into a back plane of a LCOS display, the source of radiation is a light emitting diode, and the detector is integrated into the back plane.

19. The device of claim 15, wherein the source of radiation and said at least first sensor is tuned to an invisible wavelength.

20. The device of claim 15, wherein said at least first sensor is at least one photodiode placed on a top cover of a cover glass over an electronically unmodulated area of an LCOS to check a zero voltage (un-modulated) point and/or at least another photodiode placed on the top cover of the cover glass over a ring electrode to check a maximum voltage point on an electro-optical transfer function, wherein the detector uses the voltage from the photodiodes to choose a correct common mode electrode voltage.

* * * * *